US007275481B2

(12) United States Patent
Chiba et al.

(10) Patent No.: US 7,275,481 B2
(45) Date of Patent: Oct. 2, 2007

(54) PRINTER

(75) Inventors: Keiichi Chiba, Miyagi (JP); Hironobu Takasawa, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 09/793,878

(22) Filed: Feb. 28, 2001

(65) Prior Publication Data

US 2001/0029850 A1 Oct. 18, 2001

(30) Foreign Application Priority Data

Feb. 29, 2000 (JP) ..... 2000-053757
Nov. 20, 2000 (JP) ..... 2000-352617

(51) Int. Cl.
*B41L 13/04* (2006.01)

(52) U.S. Cl. ..... 101/116; 101/216; 101/232; 474/205

(58) Field of Classification Search ..... 101/115, 101/116, 118, 122, 216, 232; 474/205, 260, 474/264

See application file for complete search history.

(56) References Cited

U.S. PATENT DOCUMENTS 4,614,510 A * 9/1986 Nishikori ..... 474/205
5,006,059 A * 4/1991 Hakoda et al. ..... 425/573
5,157,872 A * 10/1992 Nakagaki ..... 451/23
5,549,510 A * 8/1996 Fukuda et al. ..... 451/246
6,102,823 A * 8/2000 Hosokawa et al. ..... 474/242
6,296,588 B1 * 10/2001 Ciemniecki et al. ..... 474/268
6,336,885 B1 * 1/2002 Hayashi ..... 474/263
6,964,626 B1 * 11/2005 Wu et al. ..... 474/260

FOREIGN PATENT DOCUMENTS

| | | |
|---|---|---|
| JP | 4-329175 | 11/1992 |
| JP | 07-017121 | 1/1995 |
| JP | 08-216381 | 8/1996 |
| JP | 09-066657 | 3/1997 |
| JP | 09-104158 | 4/1997 |
| JP | 11-129600 | 5/1999 |

OTHER PUBLICATIONS

Pending U.S. Appl. No. 09/532,055, filed Mar. 21, 2000.
Pending U.S. Appl. No. 09/604,575, filed Jun. 27, 2000.
Pending U.S. Appl. No. 09/800,506, filed Mar. 8, 2001.
Pending U.S. Appl. No. 09/795,482, filed Mar. 1, 2001.
Pending U.S. Appl. No. 09/793,878, filed Feb. 28, 2001.
U.S. Appl. No. 09/793,878, filed Feb. 28, 2001, Chiba et al.
U.S. Appl. No. 10/453,603, filed Jun. 4, 2003, Chiba et al.

* cited by examiner

*Primary Examiner*—Daniel J. Colilla
*Assistant Examiner*—Kevin D. Williams
(74) *Attorney, Agent, or Firm*—Oblon, Spivak, McClelland, Maier & Neustadt, P.C.

(57) ABSTRACT

A printer of the present invention includes a timing belt passed over drive pulleys, each of which is mounted on a particular print drum, via phase adjusting means and deflection pulleys or rotary members. The deflection pulleys are rotatable in contact with the rear surface of the timing belt. The timing belt has its rear surface ground to have uniform thickness. The printer is free from the deviation of relative phase between the rotary members and offset ghosts ascribable to the irregular thickness of the timing belt, while preserving the low-cost configuration of timing belt connection.

4 Claims, 17 Drawing Sheets

PRINTER

BACKGROUND OF THE INVENTION

The present invention relates to a stencil printer or similar printer and more particularly to a printer including a plurality of rotary members that are interconnected by a timing belt to rotate in synchronism with each other.

Today, a stencil printer capable of producing a great number of prints at low cost is extensively used. The stencil printer includes a plurality of print drums arranged side by side in a direction in which a paper sheet or similar recording medium is conveyed. The print drums each are assigned to a particular color. While a paper sheet is passed only once, an image of the first color to an image of the last color are sequentially transferred from the print drums to the paper sheet one above the other, completing a color image. While such a single pass system is more efficient than a system of the type replacing a print drum color by color, it has problems ascribable to a short distance between the print drums.

Specifically, an ink image transferred from an upstream print drum assigned to, e.g., a first color reaches the nip of a downstream print drum assigned to, e.g., a second color in a wet state. As a result, the ink image is transferred to a master or perforated stencil wrapped around the downstream print drum and then to the next paper sheet.

More specifically, the transfer of the wet ink of the first color to the master wrapped around the downstream print drum does not matter for the first paper sheet. As for the second paper sheet, however, the ink of the first color is transferred from the above master to an image of the first color transferred from the upstream print drum to the paper sheet (so-called retransfer). Retransfer, i.e., the overlap of ink of the same color is not critical in the aspect of image quality if free from positional deviation. However, if the retransferred image is deviated from the original image, an offset ghost appears on the paper sheet. For a given amount of deviation, an offset ghost causes a thick line to appear blurred and causes a thin line to appear doubled, lowering image quality to a critical degree.

Retransfer stated above is not avoidable with a single pass type of color printer. An offset ghost is, however, ascribable to the positional deviation of transfer and can therefore be accurately reduced if the upstream and downstream print drums accurately rotate in synchronism with each other for thereby conveying a paper sheet with accuracy.

To reduce an offset ghost, it has been customary to connect the upstream and downstream print drums as to drive. Japanese Patent Laid-Open Publication No. 4-329175, for example, teaches a system that connects the shafts of the print drums by using a plurality of gears. Japanese Patent Laid-Open Publication No. 7-17121, for example, proposes a system that connects the print drums by using timing pulleys and a timing belt.

The gear scheme is capable of reducing the deviation of an offset ghost. This scheme, however, uses a plurality of precision gears and therefore increases the production cost. The timing belt scheme produces an offset ghost and, moreover, aggravates deviation thereof, as will be described specifically later with reference to the accompanying drawings.

Technologies relating to the present invention are also disclosed in, e.g., Japanese Patent Laid-Open Publication Nos. 8-216381, 9-66657, 9-104158, and 11-129600.

SUMMARY OF THE INVENTION

It is therefore an object of the present invention to provide a printer of the type connecting a plurality of print drums with a timing belt and capable of reducing eccentricity ascribable to the irregular thickness of the timing belt to thereby reduce an offset ghost, positional deviation in the top-and-bottom direction, and so forth.

It is another object of the present invention to provide a printer capable of reducing an offset ghost at low cost while using a timing belt.

In accordance with the present invention, a printer includes a drive member and a driven member. A timing belt is toothed at one surface thereof and connects the drive member and driven member such that they are rotatable in synchronism. A rotary member is rotatable in contact with the rear surface of the timing belt. The he rear surface of the timing belt is ground.

Also, in accordance with the present invention, a printer for superposing on an image formed by, among a plurality of print drums spaced from each other in the direction in which a recording medium is conveyed, an upstream print drum an image formed by a downstream print drum includes a timing belt connecting nearby print drums, and a rotary member rotatable in contact with the rear surface of the timing belt. The rear surface of the timing belt is ground.

BRIEF DESCRIPTION OF THE DRAWINGS

The above and other objects, features and advantages of the present invention will become more apparent from the following detailed description taken with the accompanying drawings in which:

FIG. 4 is a chart showing waveforms representative of velocity variations ascribable to the eccentricity of a drive pulley and that of a timing belt also included in the conventional stencil printer;

DESCRIPTION OF THE PREFERRED EMBODIMENTS

Figure 1:
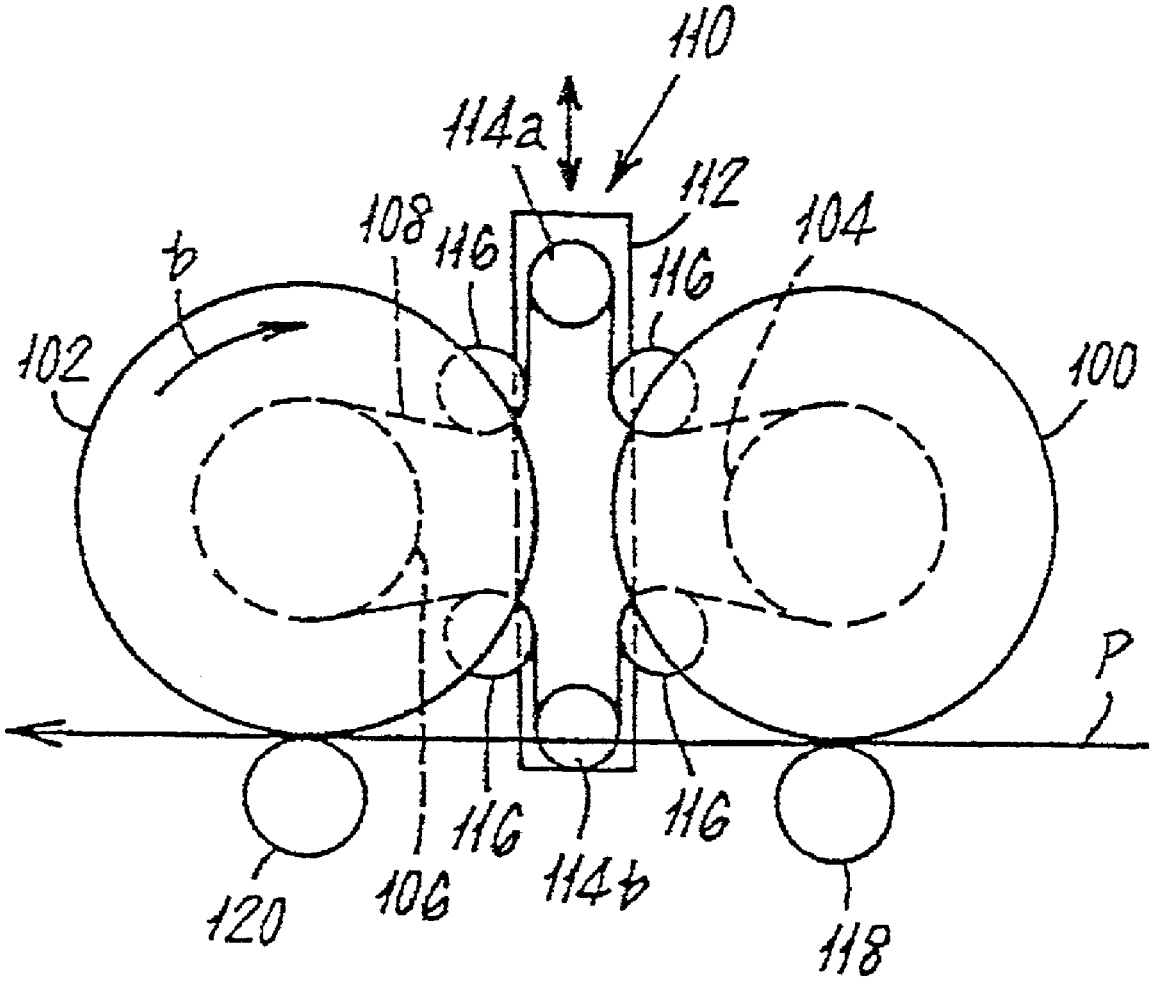
FIG. 1 PRIOR ART
FIG. 1 is a front view showing a conventional stencil printer in which nearby print drums are interconnected by a timing belt.

To better understand the present invention, reference will be made to a conventional single path, color stencil printer constructed to obviate offset ghosts, shown in FIG. 1. As shown, the stencil printer includes two print drums 100 and 102 spaced from each other in a direction in which a paper sheet or similar recording medium P is conveyed. The print drums 100 and 102 are respectively located at the upstream side and downstream 66, side in the above direction. Toothed drive pulleys 104 and 106 are respectively mounted on the print drums 100 and 102, serving as timing pulleys.

A timing belt 108 is passed over the drive pulleys 104 and 106. In this configuration, the print drums 100 and 102 are driven while being connected together by the timing belt 108. A phase adjusting device 110 is positioned between the print drums 100 and 102. The phase adjusting device 110 adjusts a relative phase between the print drums 100 and 102, i.e., corrects a positional deviation between a first and a second color in the direction of paper conveyance or top-and-bottom direction. In this sense, the phase adjusting device 110 plays the role of top-and-bottom position adjusting means.

Specifically, the phase adjusting device 110 includes a frame 112 movable up and down by being driven by drive means not shown. Toothed pulleys 114*a* and 114*b* for adjustment are rotatably mounted on the upper end and lower end of the frame 112, respectively, and held in mesh with the timing belt 108. Two pulleys 116 are fixed in place between the pulleys 114*a* and 114*b* and the print drum 100 while other two pulleys 116 are fixed in place between the pulleys 114*a* and 114*b* and the print drum 102. These pulleys 116 deflect the timing belt 108 and allow phase adjustment to be efficiently effected on the basis of the displacement of the phase adjusting means 110 in the up-and-down direction. The pulleys 116, which rotate in contact with the rear surface of the timing belt 108, are implemented by spur pulleys. Press rollers 118 and 120 are movable into and out of contact with the print drums 100 and 102, respectively.

A main motor with a speed reducing section causes the print drum 100 to rotate via a timing belt, although not shown specifically.

When the frame 112 and therefore the pulleys 114*a* and 114*b* for adjustment are moved upward, the print drum 102 is caused to rotate in a directions b although the print drum 100 connected to the main motor does not rotate. As a result, a relative phase between the print drums 100 and 102 are varied. When the frame 112 is moved downward, the phases of the print drums 100 and 102 are varied in the opposite direction. The phase adjusting device 110 is capable of correcting a positional deviation between images to be printed on the paper sheet P in the direction of paper conveyance and is essential with a color stencil printer. The deviation is ascribable to a change in print speed by way of example.

The drive pulleys 104 and 106 and pulleys 114*a* and 114*b* each involves some eccentricity due to limited machining accuracy and assembling accuracy. Further, the timing belt 108 itself involves eccentricity ascribable to the limited positional accuracy of a core wire included therein. Moreover, the pulleys 116 pressed against the rear surface of the timing belt 108 make the thickness of the timing belt 108 irregular over the entire length of the belt 108, aggravating the eccentricity of the belt 108.

As for the drive pulleys 104 and 106, eccentricity does not disturb the synchronous rotation of the print drums 100 and 102 because an offset ghost appears only once for a single rotation of the print drums 100 and 102, i.e., a single rotation of the drive pulleys 104 and 106. However, the eccentricity of the pulleys 104*a* and 104*b* disturbs the relative phase between the print drums 100 and 102 every time the pulleys 114*a* and 114*b* rotate or, when the timing belt 108 involves an eccentricity component, every time the drive pulleys 104 and 106 rotate. Why an offset ghost appears when the pulleys 114*a* and 114*b* are eccentric will be described hereinafter with reference to FIGS. 2 and 3.

Figure 2:
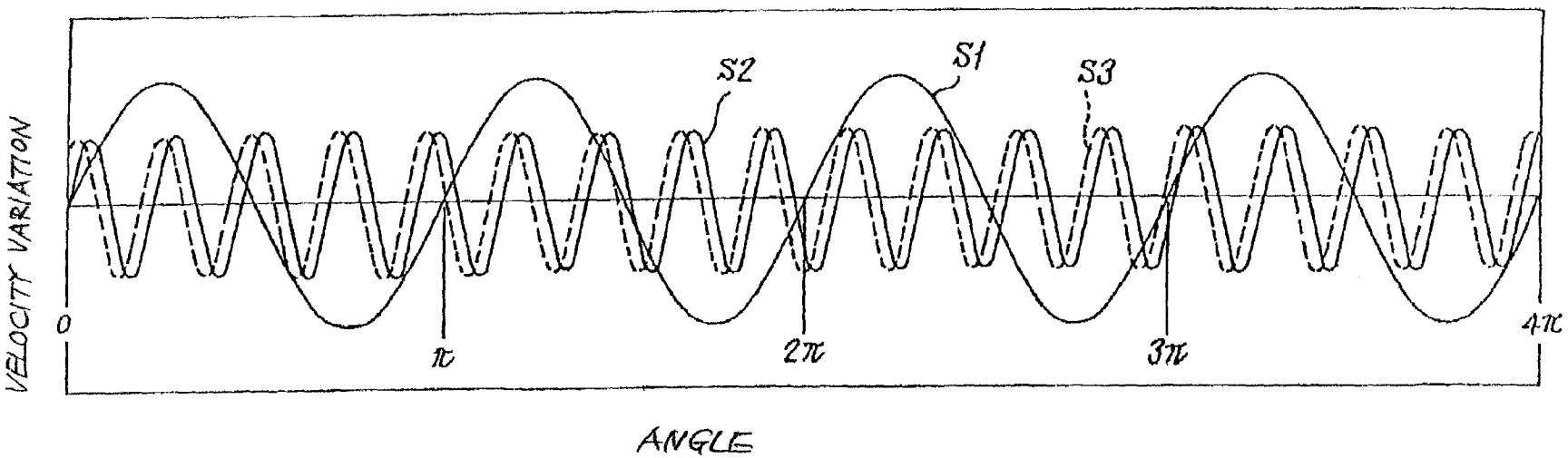
FIG. 2 PRIOR ART
FIG. 2 is a chart showing waveforms representative of velocity variations ascribable to the eccentricity of, e.g., pulleys for adjustment, which are included in the conventional stencil printer.

Assume that the ratio of the number of teeth of the drive pulley 104 or 106 to that of the pulley 114*a* or 114*b* is 4.3:1, i.e., the former is a non-integral multiple of the latter. Also, assume that the drive pulley 104 or 106 and pulley 114*a* or 114*b* are eccentric. FIG. 2 shows waveforms representative of the velocity variations of only the drive pulley 104 and pulley 114*a* by way of example measured under the above conditions. Specifically, a solid waveform S1 shows the velocity variation of the drive pulley 104. A solid waveform S2 shows the velocity variation of the pulley 114*a*; the origin of the waveform S2 is shown as being coincident with the origin of the waveform S1 for better understanding the relation. A phantom waveform S3 shows the velocity variation of the pulley 114*a* occurred when the drive pulley 104 and pulley 104*a* were different from each other in the position of eccentricity. As the waveform S3 indicates, the waveform of the pulley 114*a* has an origin that is, in many cases, not coincident with the original of the waveform of the drive pulley 104.

Figure 3:
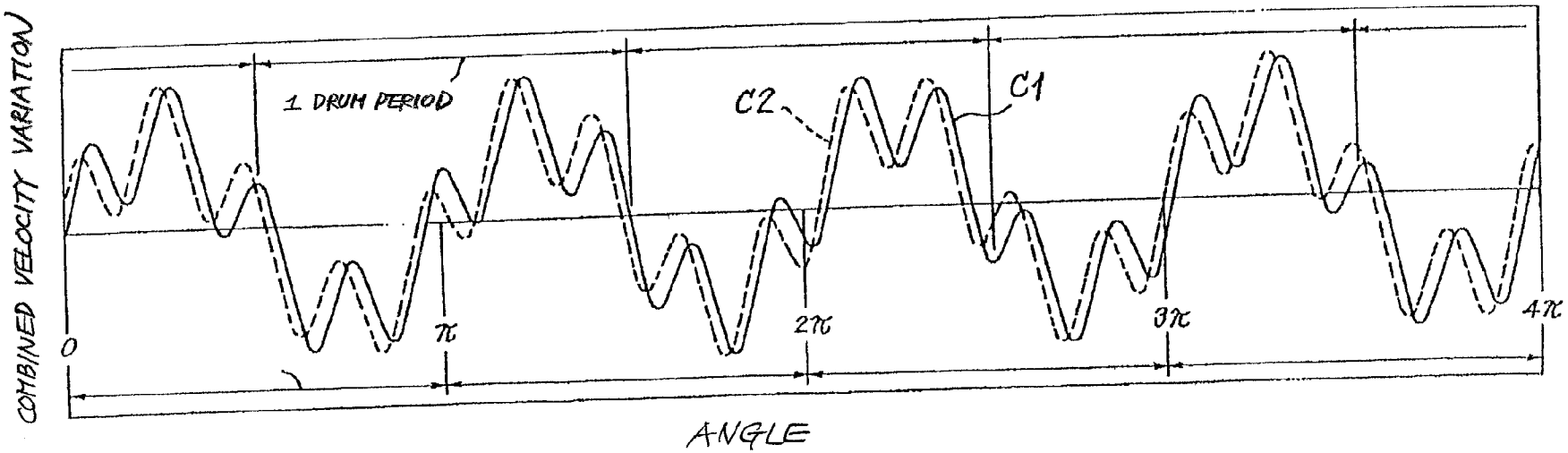
FIG. 3 PRIOR ART
FIG. 3 is a chart showing combined waveforms derived from the waveforms of FIG.
Figure 3:
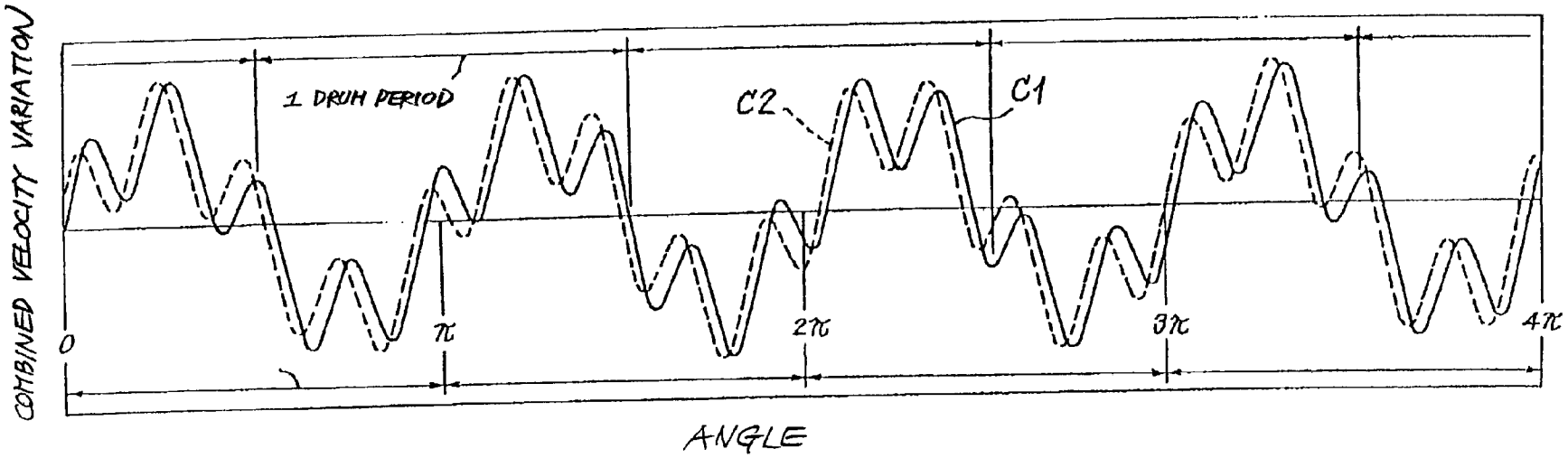
FIG. 3 PRIOR ART

FIG. 3 shows a solid waveform C1, which is a combined form of the waveforms S1 and S2 of FIG. 2, and a phantom waveform C2, which is a combined form of the waveforms S1 and S3 of FIG. 2. As shown, wherever one drum period may begin, the velocity varies in a different manner every period. Consequently, the deviation between the print drums 100 and 102 varies in a different manner every period, resulting in an offset ghost.

Figure 5:
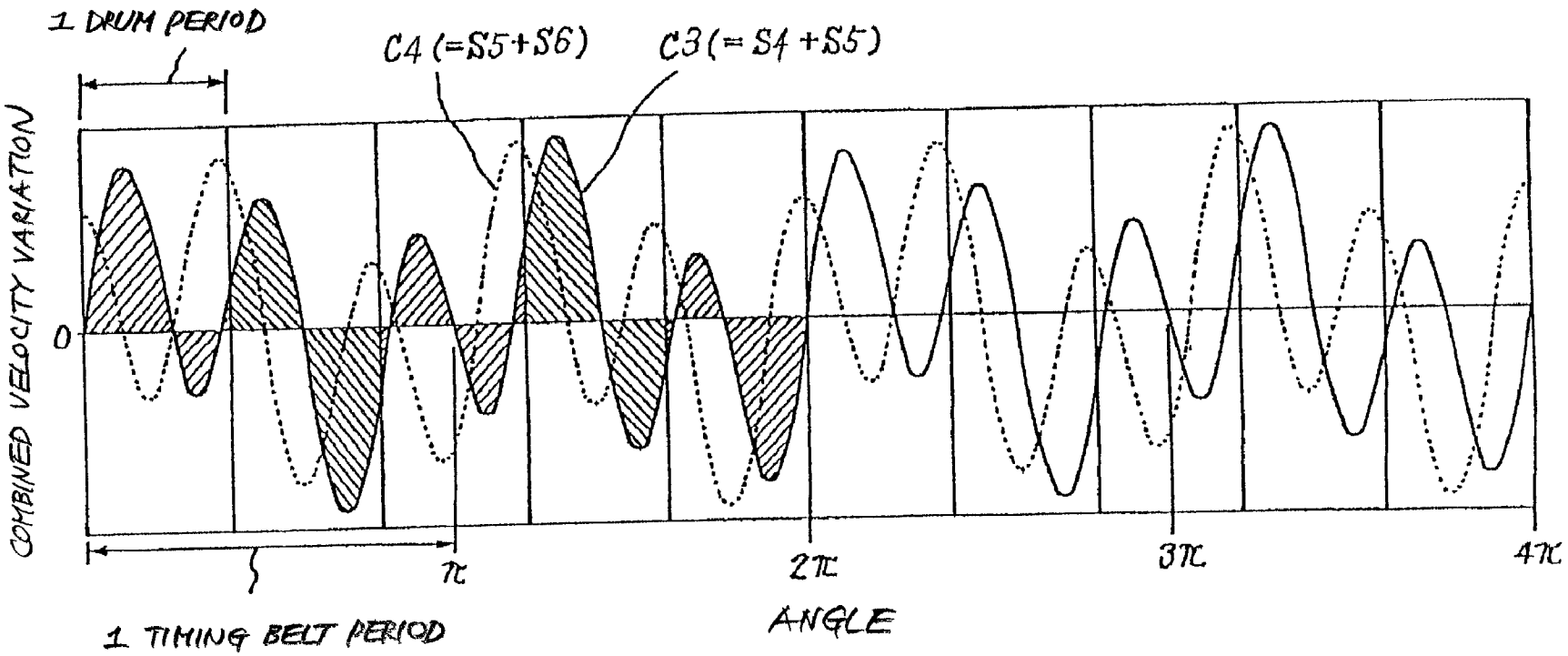
FIG. 5 PRIOR ART
FIG. 5 is a chart showing combined waveforms derived from the waveforms of FIG. 4.
Figure 6:
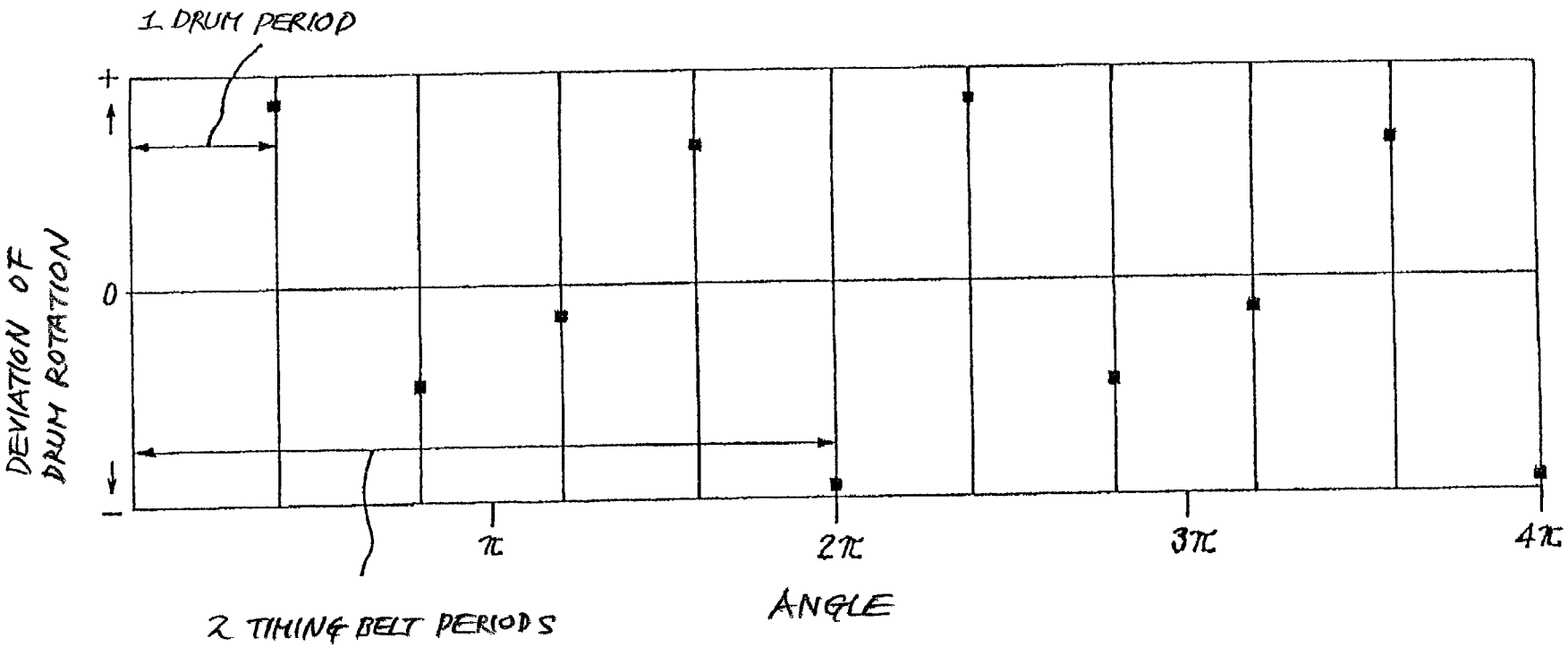
FIG. 6 PRIOR ART
FIG. 6 is a chart plotting the deviations of rotation of a print drum in terms of the sum of areas derived from the waveforms of FIG. 5.

Reference will be made to FIGS. 4 through 6 for describing an offset ghost ascribable to the eccentricity of the timing belt 108. Assume that the ratio of the number of teeth of the drive pulley 104 or 106 to that of the timing belt 108 is 1:2.5, i.e., the latter is a non-integral multiple of the former. Also, assume that the drive pulley 104 or 106 and timing belt 108 are eccentric. FIG. 4 shows waveforms representative of the velocity variations of only the drive pulley 106 and timing belt 108 by way of example measured under the above conditions.

In FIG. 4, a solid waveform S4 shows the velocity variation of the drive pulley 106. A solid waveform S5 shows the velocity variation of the timing belt 108; the origin of the waveform S5 is shown as being coincident with the origin of the waveform S4 for better understanding the relation. A phantom waveform S6 shows the velocity variation of the drive pulley 106 occurred when the drive pulley 106 and timing belt 108 were different from each other in the position of eccentricity. As the waveform S6 indicates, the waveform of the drive timing belt 108 has an origin that is, in many cases, not coincident with the original of the waveform of the drive pulley 106.

FIG. 5 shows a solid waveform C3, which is a combined form of the waveforms S4 and S5 of FIG. 4, and a phantom waveform C4, which is a combined form of the waveforms S5 and S6 of FIG. 4. As shown, wherever one period begins, the velocity varies in a different manner every period. However, the timing belt 108 and drive pulley 106 respectively have two periods and five periods because of the preselected relation in the number of teeth. The waveform C3 therefore has the same pattern repeating every five periods of the drive pulley 106.

FIG. 6 plots the sums of the areas of hatched portions shown in FIG. 5 that occur during every period of the drive pulley 106. Each sum indicates a particular deviation of the synchronism of the drive pulley 106. It will be seen that the synchronism of the drive pulley 106 repeatedly deviates by the same amount every two periods of the timing belt 108.

Generally, gears, a timing belt and so forth that connect print drums involve some eccentricity do to limited machining accuracy, so that velocity unavoidably varies during one rotation. A gear train connecting print drums is highly rigid and allows the deviation of an offset ghost to be reduced if the accuracy of the individual gear is increased. However, using a plurality of precision gears is undesirable from the cost standpoint.

On the other hand, a timing belt connecting print drums reduces the overall cost because timing pulleys or similar low-cost parts, which can be produced by injection molding or similar technology on a quantity basis, suffice. This, however, brings about the previously discussed problem that the eccentricity of the timing belt and timing pulleys aggravates the deviation of an offset ghost.

As stated above, the eccentricity of various rotary members is the cause of an offset ghost. As for the eccentricity of the timing belt, assume that the core wire is accurately positioned, but the thickness of the belt is irregular over the entire length. Then, the pulleys 116, for example, contacting the rear surface of the timing belt cause the varying thickness of the belt to appear as the eccentricity component of the belt, resulting in an offset ghost. Therefore, reducing the variation of the thickness of the timing belt is extremely effective to reduce an offset ghost ascribable to the belt.

Because an offset ghost appears only once for a single rotation of the print drum, no offset ghosts will appear if the period of the print drum and that of the timing belt are held in a ratio of 1:1, as stated earlier. However, such a configuration is not practicable without resorting to precision gears, which are costly and cancel the merit of the timing belt scheme.

Figure 7:
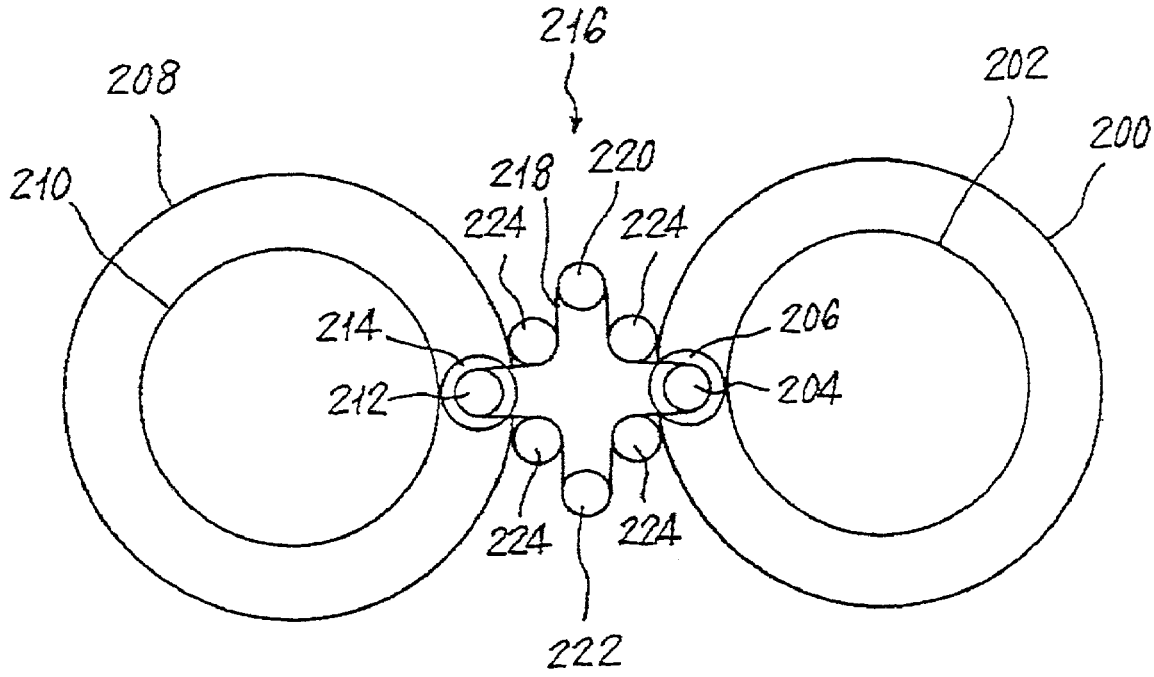
FIG. 7 PRIOR ART
FIG. 7 is a front view showing a specific configuration that maintains a ratio of 1:1 between the period of a print drum and that of a timing belt.

FIG. 7 shows a specific arrangement that maintains the ratio of 1:1 between the period of the print drum and that of the timing belt. As shown, a gear 206 includes a timing pulley 204 and is held in mesh with a drive gear 202 mounted on an upstream print drum 200. Likewise, a gear 214 includes a timing pulley 212 and is held in mesh with a drive gear 210 mounted on a downstream print drum 208. A timing belt 218 is passed over the timing pulleys 204 and 212 via a phase adjusting device 216. In this condition, the print drums 200 and 208 are capable of rotating in interlocked relation. There also shown in FIG. 7 pulleys 220 and 222 for adjustment and pulleys 224 for deflection.

The above arrangement implementing the ratio of 1:1 needs a plurality of gears, i.e., the drive gears 202 and 210 and gears 206 and 214. Moreover, the gears 202, 210, 206 and 214 must be finished with precision high enough to realize the ratio of 1:1 at the sacrifice of cost.

The foregoing description has concentrated on the offset ghost problem brought about in a color printer in which a plurality of print drums are arranged in the direction of paper conveyance. The offset ghost problem also occurs in, e.g., other prior art timing belt connection, examples of which are as follows. Japanese Laid-Open Publication No. 8-216381, for example, shows in FIGS. 5 and 6 timing belt connection between a print drum and a top-and-bottom position adjusting device that adjusts the positional deviation of an image in the direction of paper conveyance. Further, this document shows in FIGS. 9 and 10 timing belt connection between a first and a second print drum facing each other. Japanese Patent Laid-Open Publication No. 9-66657, for example, teaches timing belt connection between a print drum and paper feeding means.

Besides an offset ghost, the position of an image is shifted by the eccentricity component of a timing belt occurring between a drive member and a driven member. Specifically, assume that idle pulleys or similar rotary members rotate in contact with the rear surface of a timing belt, and that the timing belt involves an eccentricity component. Then, because a drive and a driven idle pulley each makes a plurality of rotations (a plurality of times of printing) for a single turn of the timing belt, the eccentricity component of the belt disturbs a relative phase between, e.g., a print drum and top-bottom position adjusting means. As a result, the position of an image in the top-and-bottom direction is shifted between consecutive printing.

Figure 8:
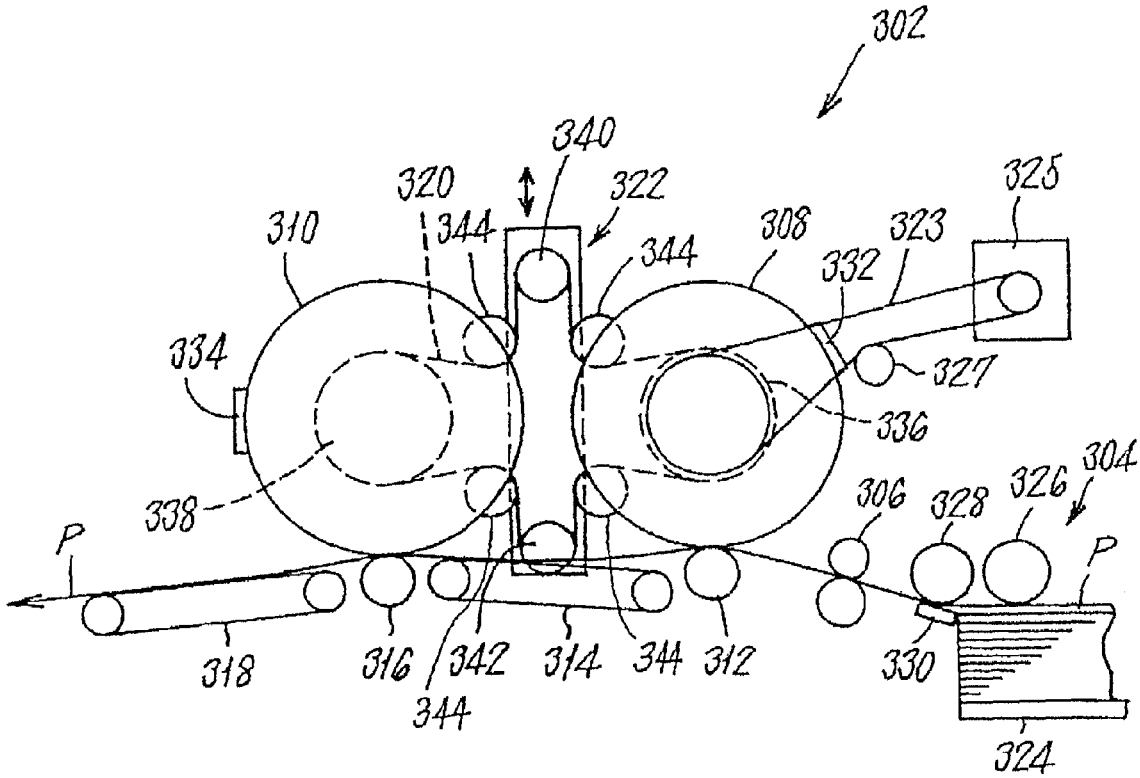
FIG. 8 is a front view showing a printer embodying the present invention.

Referring to FIG. 8, a stencil printer embodying the present invention and representative of a printer will be described. As shown, the stencil printer, generally 302, includes two print drums 308 and 310. Paper feeding means 304 feeds a paper sheet P toward the print drums 308 and 310 via a registration roller pair 306. The print drums 308 and 310 are spaced from each other in the direction in which the paper sheet P is conveyed. A moving mechanism, not shown, moves a press roller 312 into and out of contact with the upstream print drum 308. Intermediate conveying means 314 is positioned between the print drums 308 and 310 for conveying the paper sheet P and includes an endless belt. A moving mechanism, not shown, moves a press roller 316 into and out of contact with the downstream print drum 310. Outlet conveying means 318 conveys the paper sheet P peeled off from the print drum 310 to a print tray not shown. A timing belt 320 connects the print drums 308 and 310. Phase adjusting means adjusts a relative phase between the print drums 308 and 310.

A main motor 325 causes the upstream print drum, or drive member, 308 via a main drive belt 323. The rotation of the print drum 308 is transmitted to the downstream print drum, or driven member, 310 via the timing belt 320. A pulley 327 applies tension to the main drive belt 323.

The paper feeding means 304 includes a tray 324 loaded with a stack of paper sheets P and intermittently movable upward. A pickup roller 326, a separator roller 328 and a separator pad 330 cooperate to pay out the top paper sheet P from the tray 324 toward the registration roller pair 306.

The registration roller pair 306 corrects, e.g., the skew of the paper sheet P. The roller pair 306 then drives the paper sheet P toward the print drum 308 at such a timing that the leading edge of the paper sheet P meets the leading edge of an image formed on the print drum 308.

Ink feeding means, not shown, is arranged within the print drum 308 and feeds ink of a first color to the inner periphery of the drum 308. The press roller 312 presses the paper sheet P arrived at the print drum 308 against the drum 308 via a master, which is wrapped around the drum 308. As a result, the ink is transferred to the paper sheet P via the porous portion of the print drum 308 and perforations formed in the master, printing an image on the paper sheet P in the first color. The press roller 312 is intermittently pressed against the print drum 308 so as not to interfere with a master damper 332 mounted on the drum 308.

Peeling means peels off the paper sheet P carrying the image thereon from the print drum 308. Subsequently, the previously mentioned belt included in the intermediate conveying means 314 conveys the paper sheet. At this instant, a fan also included in the conveying means 314 sucks the paper sheet P to thereby retain the paper sheet P on the belt. The conveying means 314 conveys the paper sheet P at a linear velocity preselected times higher than the linear velocity of the paper sheet P.

Ink feeding means, not shown, is also arranged within the print drum 310 and feeds ink of a second color to the inner periphery of the drum 310. As the paper sheet P with the image of the first color arrives at a nip between the downstream print drum 310 and the press roller 316, the roller 316 presses the paper sheet P against the drum 310. As a result, the ink is transferred to the paper sheet P via the porous portion of the print drum 308 and perforations formed in the master, printing an image on the paper sheet P in the second color over the image of the first color. The press roller 316 is intermittently pressed against the print drum 310 so as not to interfere with a master damper 334 mounted on the drum 310.

Peeling means, not shown, peels off the paper sheet or bicolor print P from the print drum 310. Subsequently, a belt included in the outlet conveying means 318 conveys the bicolor print P to the print tray not shown. At this instant, a fan also included in the conveying means 318 sucks the print P to thereby retain it on the belt.

Figure 9:
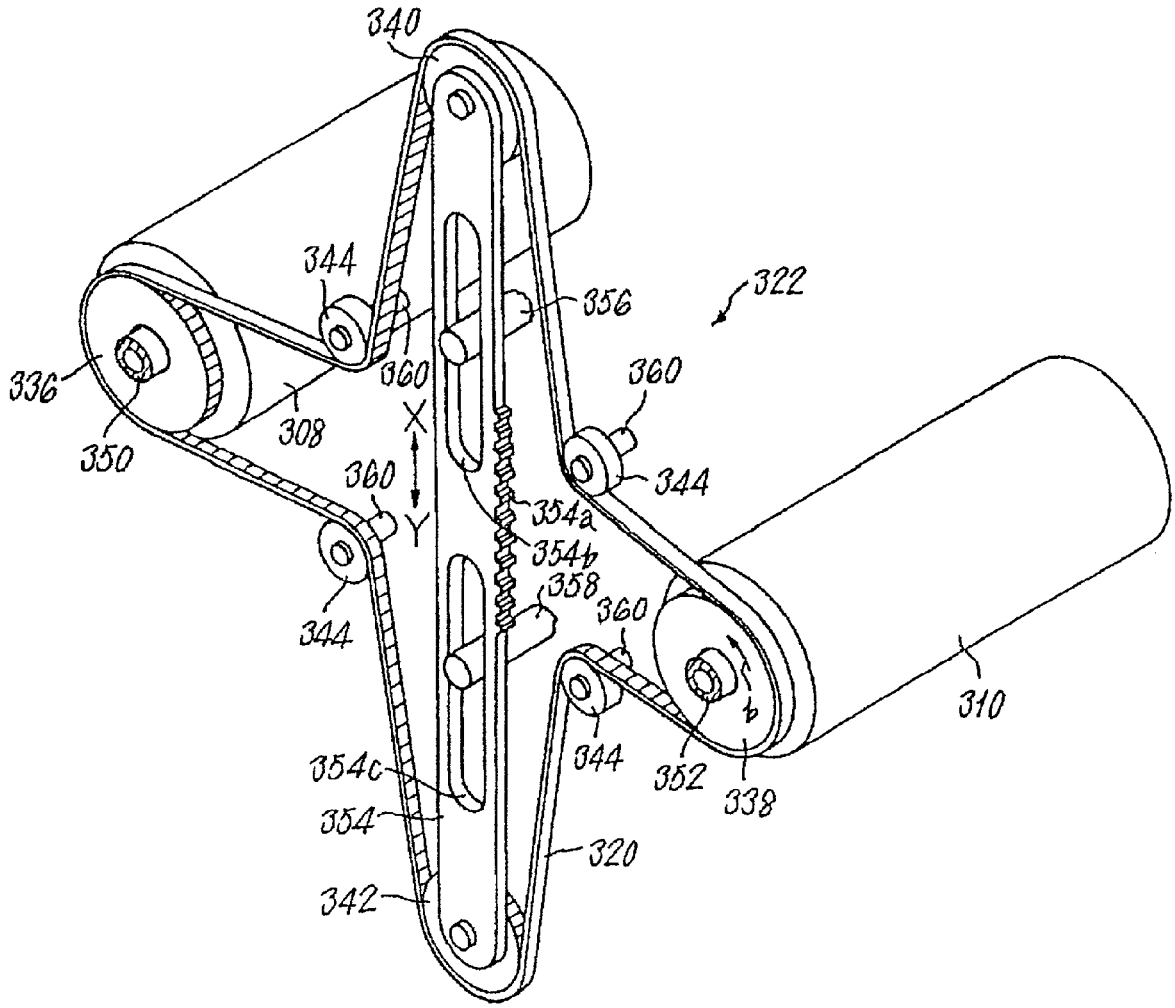
FIG. 9 is an isometric view showing a phase adjusting device intervening between print drums in the illustrative embodiment.

As shown in FIG. 9, the print drums 308 and 310 are mounted on shafts 350 and 352, respectively. Toothed drive pulleys, or timing pulleys, 336 and 338 are respectively mounted on the rear ends of shafts 350 and 352 (front ends as viewed in FIG. 9) such that the print drums 308 and 310 are replaceable. A timing belt 320 is passed over the drive pulleys 336 and 338.

The phase adjusting means 322 includes a frame 354 elongate in the up-and-down direction. An upper pulley 340 and a lower pulley 342 for adjustment are respectively mounted on the upper end and lower end of the frame 354, playing the role of timing pulleys. Four pulleys 344 are fixed in place between the pulleys 340 and 342 and the drive pulleys 336 and 338, as illustrated. The pulleys 344 allow the relative phase to be efficiently adjusted by a small displacement of the frame 354. The pulleys 344 are rotary members rotatable in contact with the rear of the timing belt 320 (surface opposite to the toothed surface). The pulleys 344 play the role of tension pulleys at the same time. As shown in FIG. 9, the phase adjusting means 322 additionally includes a rack 354*a* formed in the frame 354, a pinion, not shown, meshing with the rack 354*a*, and a motor, not shown, for driving the pinion.

As shown in FIG. 9, elongate slots 354*b* and 354*c* are respectively formed in the upper portion and lower portion of the frame 354, and each extends in the up-and-down direction. Guide pins 356 and 358 are studded on a sidewall, not shown, included in the printer body. The guide pins 356 and 358 are received in the slots 354*b* and 354*c*, respectively. The frame 354 is movable up and down while being guided by the guide pins 356 and 358 and guide members, not shown, affixed to the sidewall of the apparatus body.

The pulleys, or plain pulleys, 344 each are rotatably mounted on a respective shaft 360 affixed to the sidewall of the printer body. The pulleys 344 contact the rear surface of the timing belt 320 while squeezing the belt 320, as illustrated.

Assume that the pinions, not shown, are rotated to cause the frame 354 to move upward in a direction X. Then, the pulleys 340 and 342 are moved upward together with the frame 354, causing the print drum. 310 to rotate in a direction b. At this instant, the other print drum 308 connected to the main motor 325 does not rotate. As a result, a relative phase between the print drums 208 and 310 varies so as to correct a positional deviation between the first and second colors. When the pinion is rotated in the opposite direction, the frame 354 is moved downward in a direction Y and effects phase adjustment in the opposite direction.

The drive pulleys 336 and 338 have the same number of teeth, which is greater than the number of teeth of the pulleys 340 and 342 included in the phase adjusting means 322. The pulleys 340 and 342 have the same number of teeth.

Figure 10:
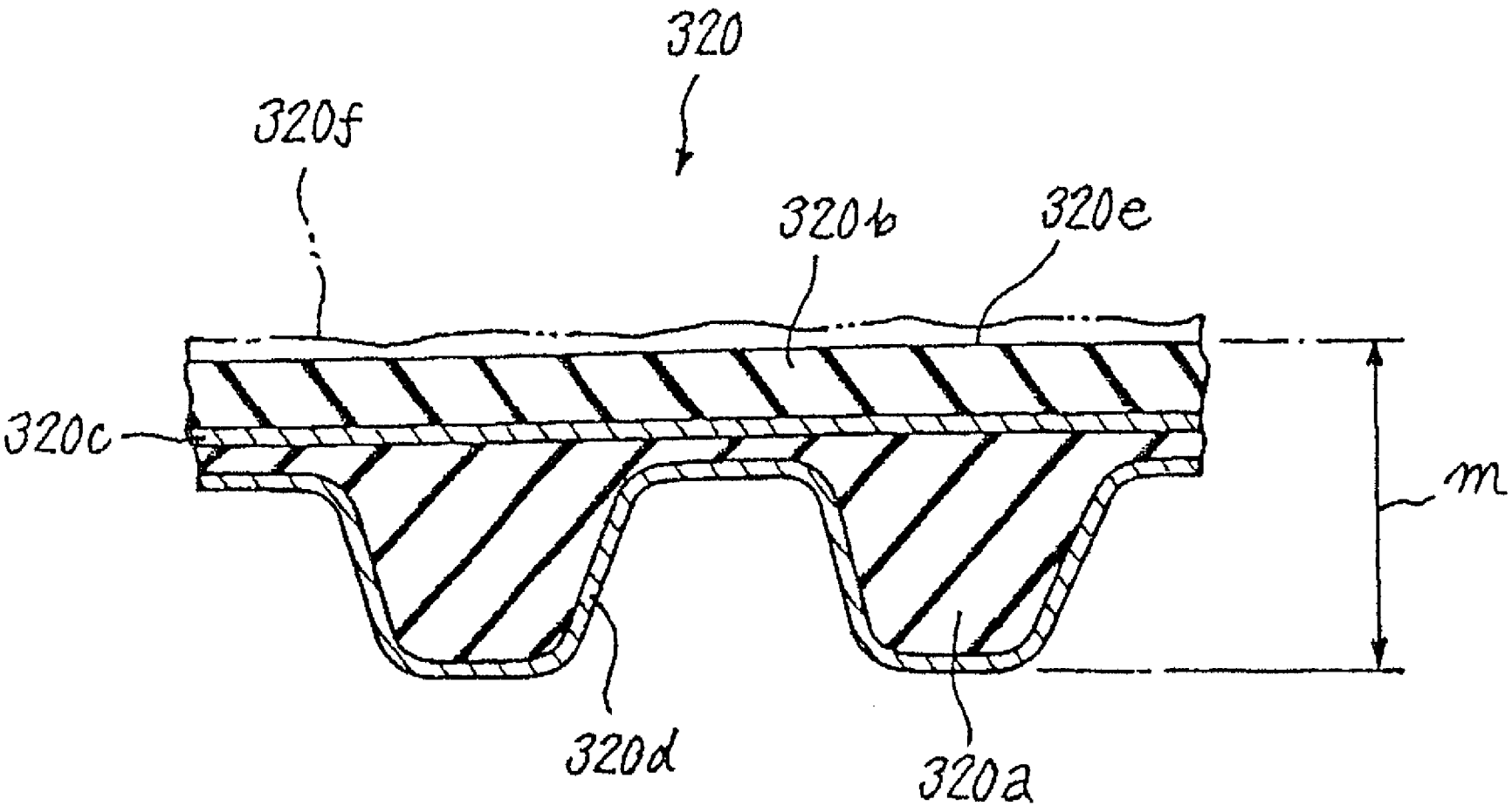
FIG. 10 is a fragmentary section of the timing belt shown in FIG. 9.

In the illustrative embodiment, the timing belt 320 is formed of conventional materials. Specifically, as shown in FIG. 10, the timing belt 320 is a laminate of a tooth portion 320*a*, a back portion 320*b*, a core wire 320*c* intervening between the two portions 320*a* and 320*b*, and a cover cloth 320*d* covering the surface of the tooth portion 320*a*. The tooth portion 320*a* and back portion 320*b* are formed of chloroprene rubber. The core wire 320*c* is formed of, e.g., glass fibers or aramid cords while the cover cloth 320*d* is formed of nylon.

Figure 19:
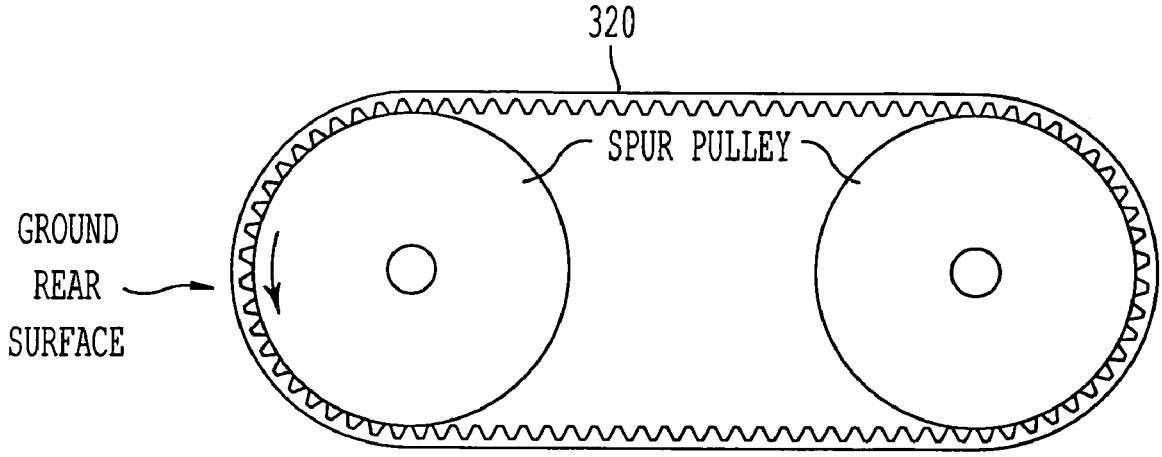
FIG. 19 shows an example of a spur pulley grinding the rear surface of the timing belt.
Figure 20:
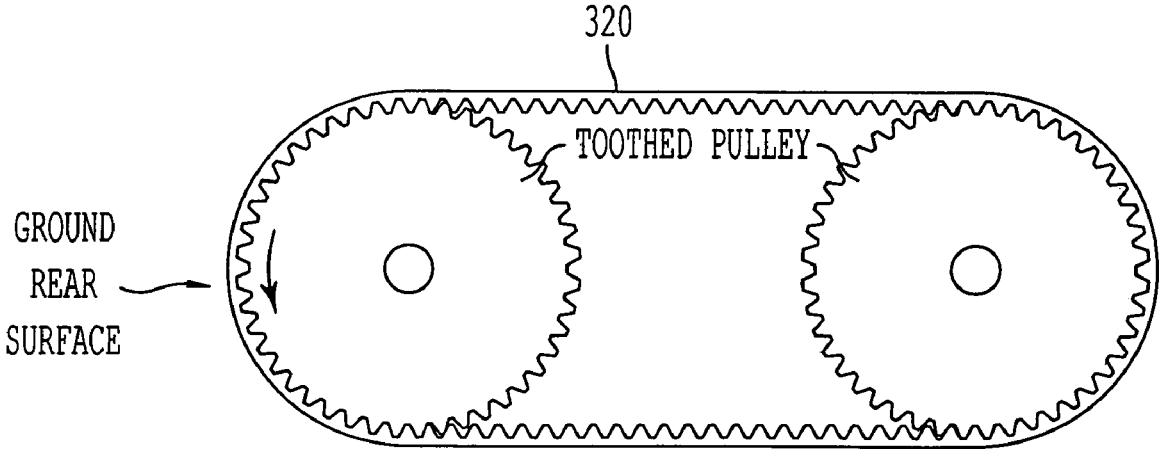
FIG. 20 shows an example of a toothed pulley grinding the rear surface of the timing belt.

What is unique to the timing belt 320 of the illustrative embodiment is that the surface 320*e* of the back portion 320*b*, i.e., the rear surface of the belt 320 is ground to uniform the thickness m of the belt 320. The surface of the belt 320 before grinding is labeled 320*f* and shown in an exaggerated scale. For example, the belt 320 may be passed over spur pulleys (SP) and turned in order to grind the rear surface 320*e* (as shown in FIG. 19), using the tooth crest (TC) as a reference. Alternatively, the belt 320 may be passed over toothed pulleys (TP) and turned in order to grind the rear surface 320*e* (as shown in FIG. 20), using the bottom land (BL) as a reference. To accurately finish the rear surface 320*e* or when the belt 320 is formed of rubber, the scheme using the bottom land (BL) as a reference is desirable because the entire tooth surface bears the load.

Figure 11:
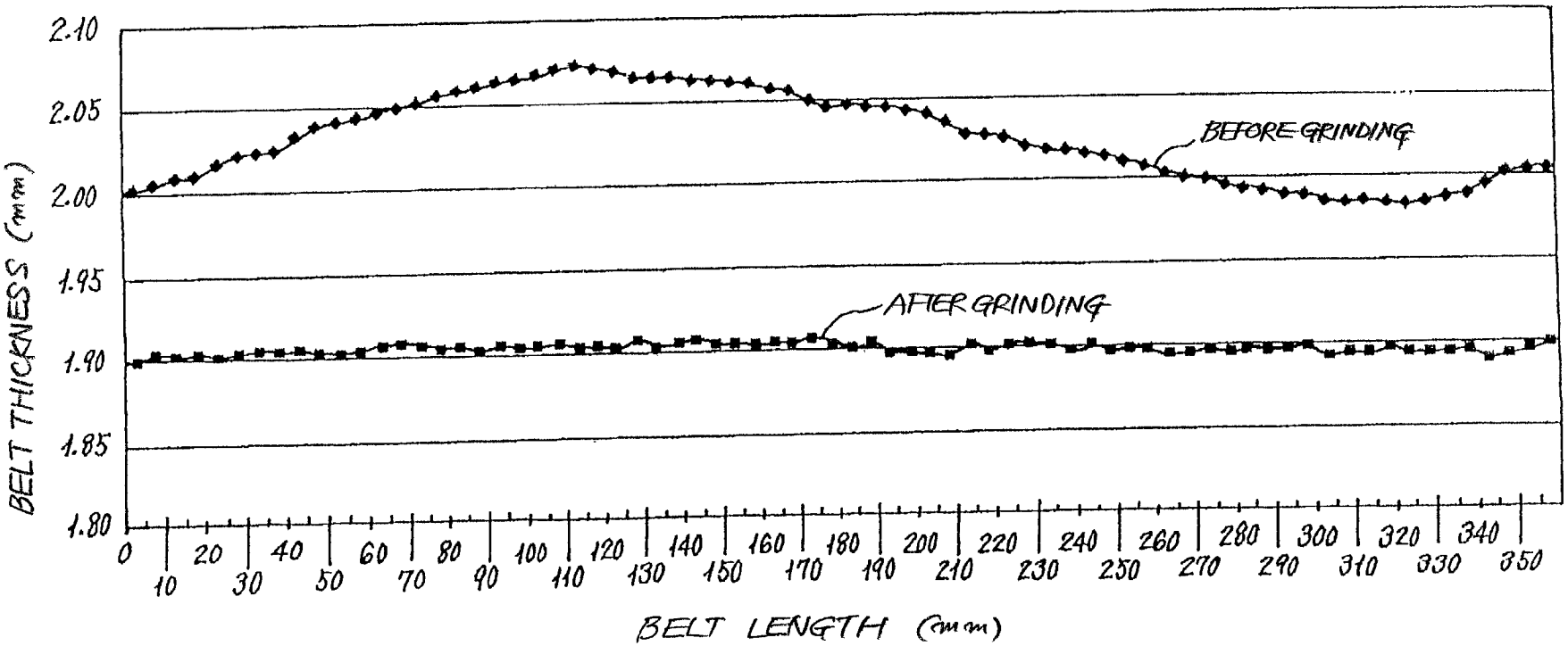
FIG. 11 is a graph showing how the thickness of the entire timing belt varies before and after grinding.

FIG. 11 shows curves respectively showing variations in the thickness of the entire timing belt 320 measured before and after grinding. As shown, while the maximum variation of the thickness is about 0.1 mm before grinding, substantially no variation occurs after grinding. Grinding, therefore, prevents the eccentricity component of the belt 320 ascribable to irregular thickness from appearing via the pulleys 344 and translating into an offset ghost. It was experimentally found that the belt 320 with the ground surface 320*e* reduced an offset ghost more than the belt 320 with the non-ground surface 320*e*. While the thickness of the belt 320 cannot be easily uniformed during production due to, e.g., the elasticity of rubber, it can be easily unformed after production by grinding.

How the illustrative embodiment reduces an offset ghost ascribable to the eccentricity of rotary members other than the timing belt 320 will be described hereinafter. In the illustrative embodiment, the pulleys 340 and 342 for adjustment each has a number of teeth that is 1/integer of the number of teeth of the drive pulley 336 or 338. Stated another way, the drive pulleys 336 and 338 each has a number of teeth that is an integral multiple of the number of teeth of the pulley 340 or 342. For example, when the drive pulley 336 or 338 has 144 teeth, the pulley 340 or 342 has thirty-six teeth. In this condition, even if the pulleys 340 and 342 are eccentric, no deviation in phase or synchronous rotation occurs between the print drums 308 and 310 because of the relation in the number of teeth. Consequently, an offset ghost is successfully reduced. This will be described more specifically hereinafter with reference to FIGS. 12 and 13.

Figure 12:
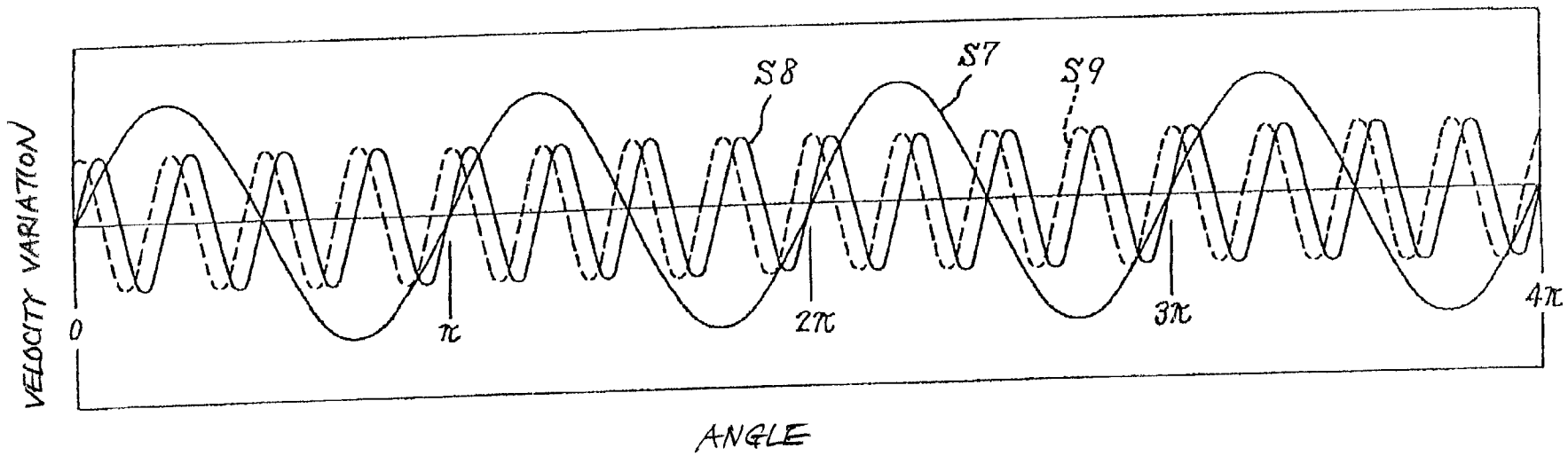
FIG. 12 is a chart showing velocity variations ascribable to the eccentricity of, e.g., pulleys for adjustment included in the illustrative embodiment.

FIG. 12 shows velocity variations ascribable to the eccentricity of the drive pulleys 336 and 338 and that of pulleys 340 and 342 and determined when the ratio of the number of teeth of the pulleys 336 and 338 to that of the pulleys 340 and 342 was 4:1. It is to be noted that FIG. 12 concentrates on the drive pulley 336 and pulley 340 by way of example.

In FIG. 12, a solid waveform S7 shows the velocity variation of the drive pulley 336. A solid waveform S8 shows the velocity variation of the pulley 340; the origin of the waveform S8 is shown as being coincident with the origin of the waveform S7 for better understanding the relation. A phantom waveform S9 shows the velocity variation of the pulley 340 occurred when the drive pulley 336 and pulley 340 were different from each other in the position of eccentricity. If positions of eccentricity are coincident, just four periods of the pulley 340 (342) occur during one period of the drive pulley 336 (338).

Figure 13:
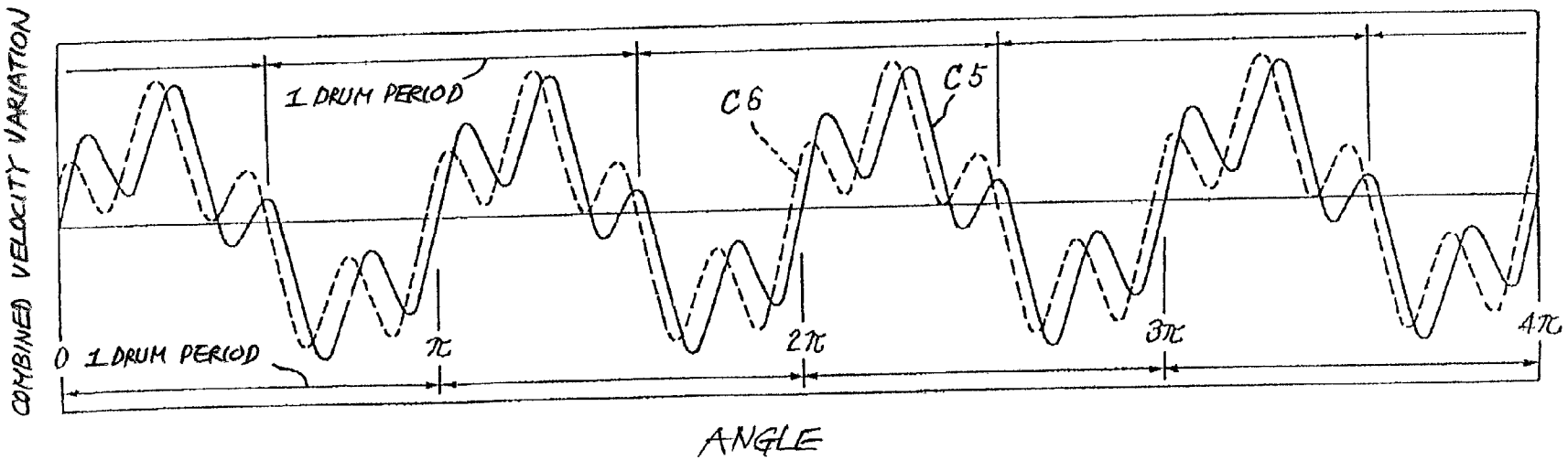
FIG. 13 is a chart showing combined waveforms derived from the waveforms of FIG. 12.

FIG. 13 shows a solid waveform C5, which is a combined form of the waveforms S7 and S8 of FIG. 12, and a phantom waveform C6, which is a combined form of the waveforms S8 and S9 of FIG. 12. As shown, wherever one period begins, the velocity varies in the same manner every period, i.e., the velocity varies in the same pattern on both of the waveforms C5 and C6. It follows that the print drums 308 and 310 deviate in the same manner every period, obviating an offset ghost.

Figure 14:
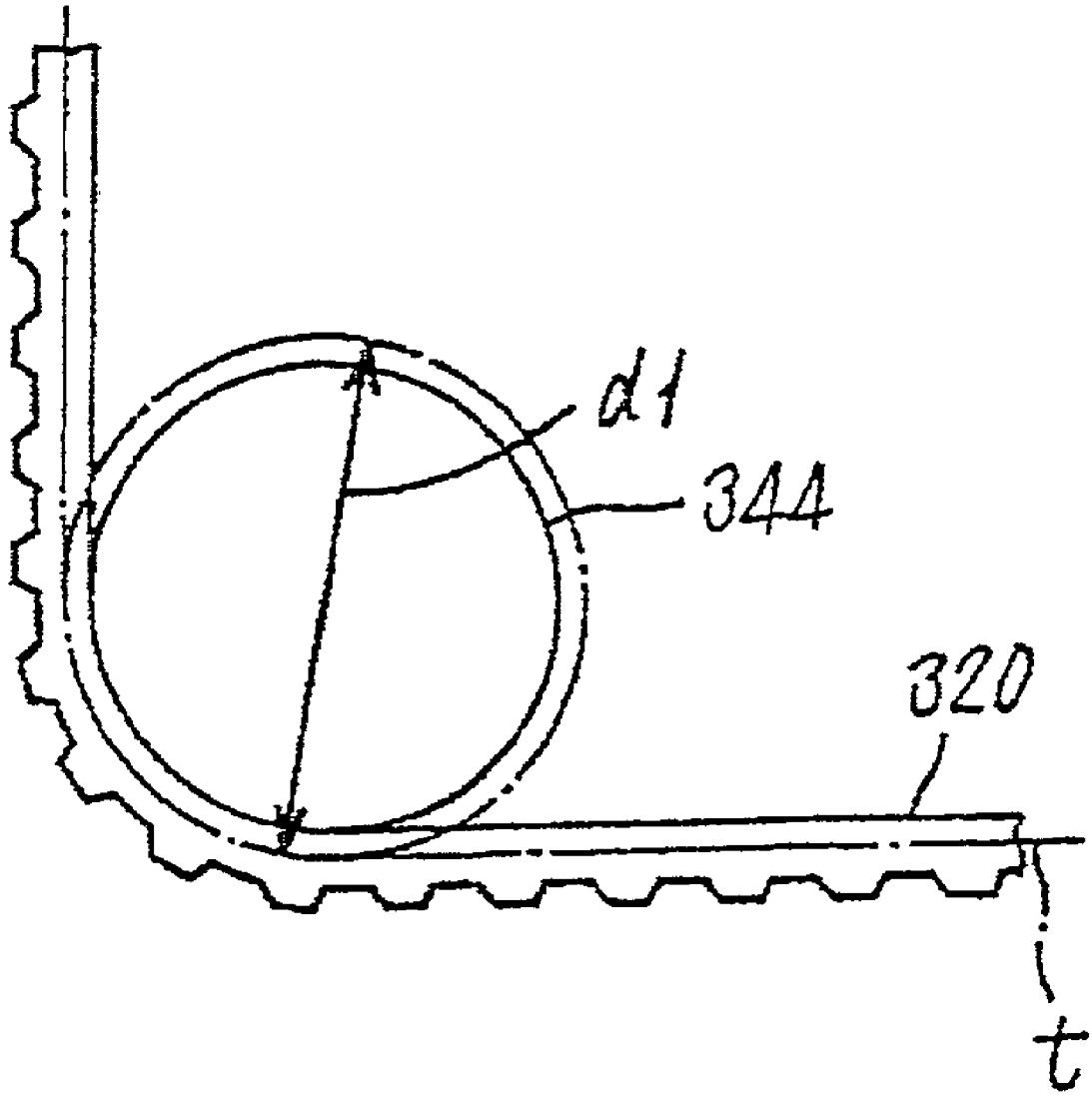
FIG. 14 is a fragmentary view showing the concept of the pick circle diameter of a deflection pulley.

When the pulleys 344 are present, as stated above, the pitch circle diameter of the pulleys 344 may be selected to be 1/integer of the pitch circle diameter of the drive pulleys 336 and 338 in addition to the previous condition of 1/interger relating to the number of teeth. Stated another way, the drive pulleys 336 and 338 each has a pitch circle diameter that is an integral multiple of the pitch circle diameter of the pulleys 344. For example, when the ratio of the pitch circle diameter of the drive pulleys 336 and 338 to that of the pulleys 344 may be selected to be 5:1. The pulleys 344 have the same pitch circle diameter. In this case, as shown in FIG. 14, the pulleys 344 each has a pitch circle diameter d1 extending to the pitch line (core wire) t of the timing belt 320.

Assume that the pulleys 340 and 342 for adjustment are free from eccentricity, but the pulleys 344 for deflection are eccentric. Then, an offset ghost can be reduced only if the pitch circle diameter of the pulleys 344 are selected to be 1/integer of the pitch circle diameter of the drive pulleys 336 and 338.

In the illustrative embodiment, 144 teeth and 36 teeth are respectively assigned to the drive pulleys 336 and 338 and pulleys 340 and 342 as a preferred example of the ratio of 4:1. If the ratio of 4:1 using other numbers of teeth or another integral ratio of 3:1 or 5:1 is selected in consideration of balance between accuracy and cost, then the number of teeth of the drive pulleys 336 and 38 should be between 108 and 180.

As shown in FIG. 8, the illustrative embodiment connects the print drums 308 and 310 simply with the timing belt 320 passed over the drive pulleys 336 and 338 and rotary members including pulleys 340 and 342 for adjustment and pulleys 344 for deflection. This obviates the need for precision gears. Therefore, even if any one of the above rotary members is eccentric, the ratio of the pitch circle diameter of the individual rotary member to that of the drive pulley 336 and 338 remains to be 1/integer, obviating a phase difference between the print drums 308 and 310. However, the ratio of the number of teeth of the timing belt 320 to that of the drive pulleys 336 and 338 cannot be 1:1 due to the extremely simple connecting scheme. As a result, the eccentricity of the timing belt 320 itself is the only possible cause of phase deviation.

Nevertheless, the rear surface 320*e* of the timing belt 320 is ground to reduce the eccentricity component of the belt 320. This, coupled with the previously stated cancellation of the eccentricity components of the rotary members, accurately reduces an offset ghost.

Figure 15:
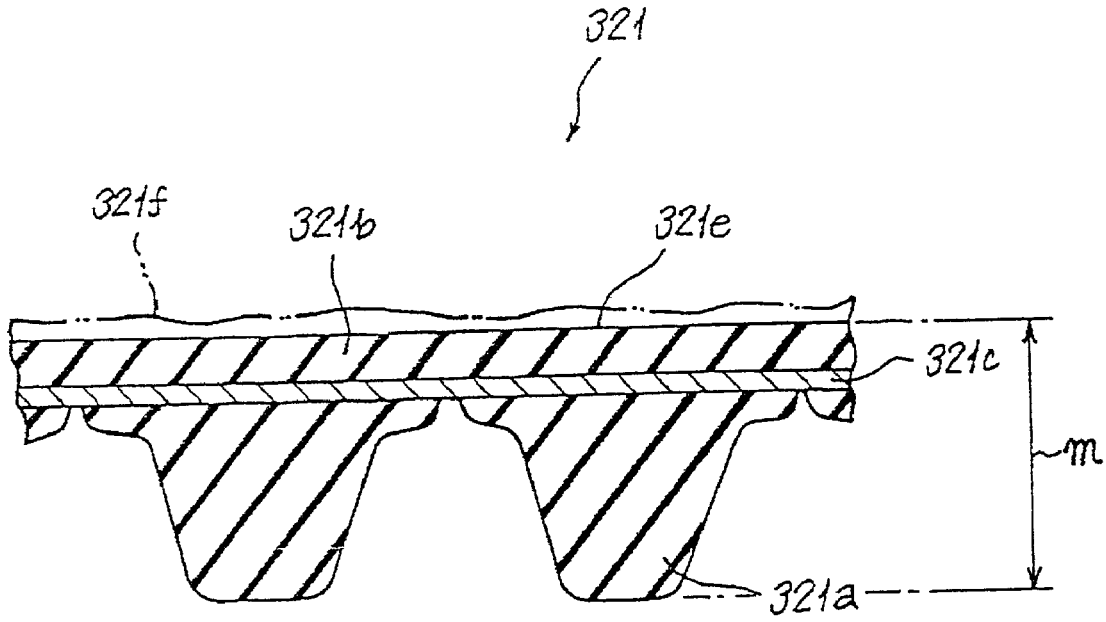
FIG. 15 is a fragmentary view of a timing belt representative of an alternative embodiment of the present invention.
Figure 16:
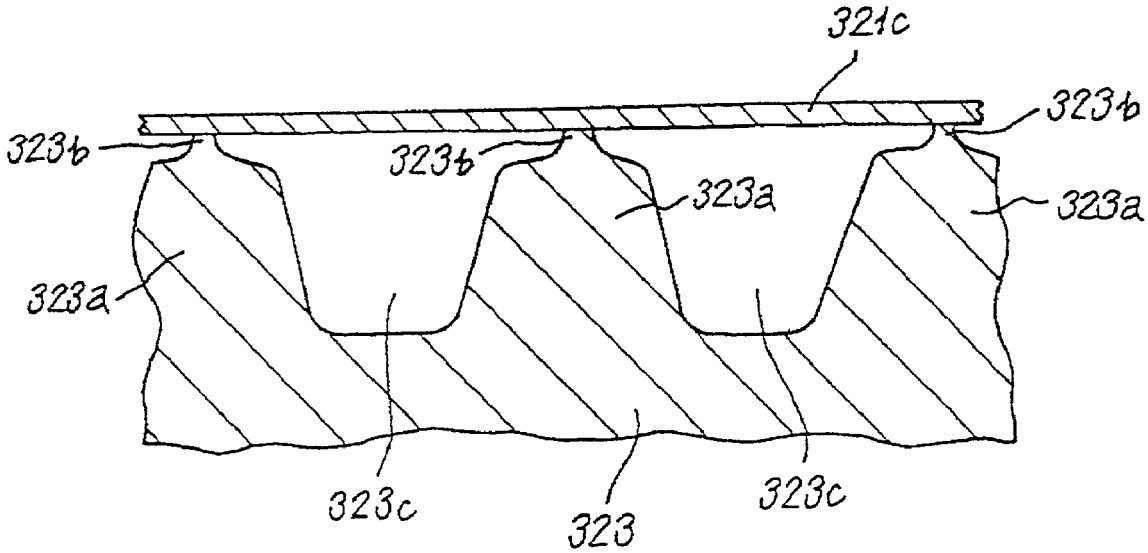
FIG. 16 is a fragmentary view of a mold used to produce the timing belt shown in FIG. 15.

Reference will be made to FIGS. 15 and 16 for describing an alternative embodiment of the present invention. As shown in FIG. 15, a timing belt 321 includes a tooth portion 321*a* and a back portion 321 molded integrally by use of polyurethane resin. A core wire 321*c* is inserted between the tooth portion 321*a* and the back portion 321*b* and implemented by glass fibers or aramid cords. As shown in FIG. 16, to produce the timing belt 321, use is made of a mold 323 including a core 323*a* that is formed with lugs 323*b* at the crests. After the core wire 321*c* has been wound round the lugs 323*b*, polyurethane resin is injected into cavities 323*c*.

In the illustrative embodiment, too, the rear surface 321*e* of the timing belt 321 is ground to uniform the thickness m. The rear surface before grinding is labeled 321*f* and shown in an exaggerated scale. The belt 321 formed of polyurethane resin has higher hardness than the belt of the previous embodiment formed of chloroprene rubber and can therefore be accurately ground even by the tooth-crest reference scheme. However, the illustrative embodiment uses the bottom-land reference scheme in order to further enhance uniform thickness.

The timing belt 321 is produced by positioning the core wire 321*c* in the mold 323 beforehand and then filling polyurethane resin for integral molding, as stated above. This is successful to accurately position the core wire 321*c* and therefore to reduce an offset ghost ascribable to the core wire 321*c*. In addition, the rear surface 321*e* of the belt 321 is ground to uniform the thickness to thereby further reduce the offset ghost. Therefore, an offset ghost ascribable to the entire timing belt 321 is accurately reduced.

While the timing belt 321 is formed of polyurethane rubber, it may be formed of any other synthetic resin satisfying the characteristic required of the belt 321.

The foregoing embodiments have pertained to offset ghost cancellation in a bicolor printer. Another alternative embodiment to be described hereinafter is applicable to timing belt connection between any other drive member and a driven member associated therewith included in a printer and needing accurate synchronous rotation.

Figure 18:
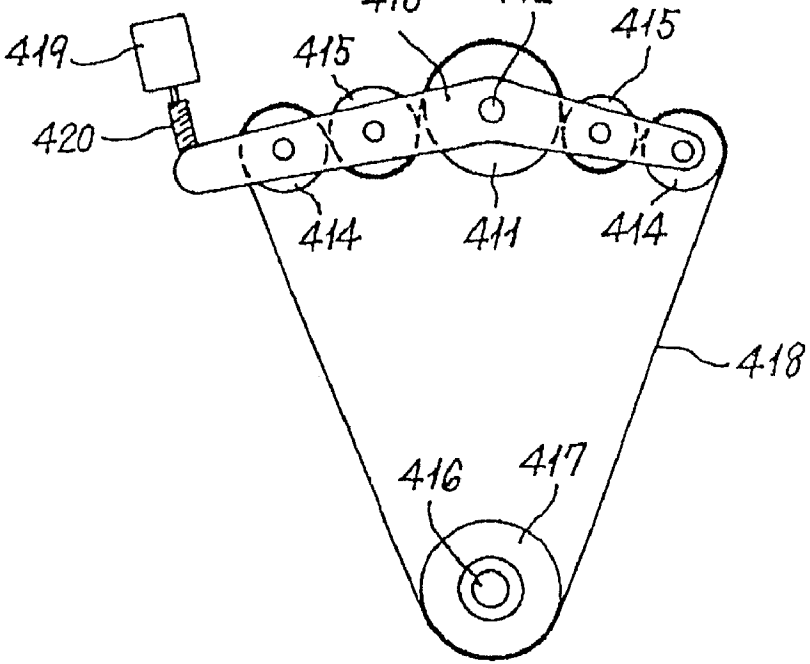
FIG. 18 is a view showing the timing belt connection included in the embodiment of FIG. 17.
Figure 17:
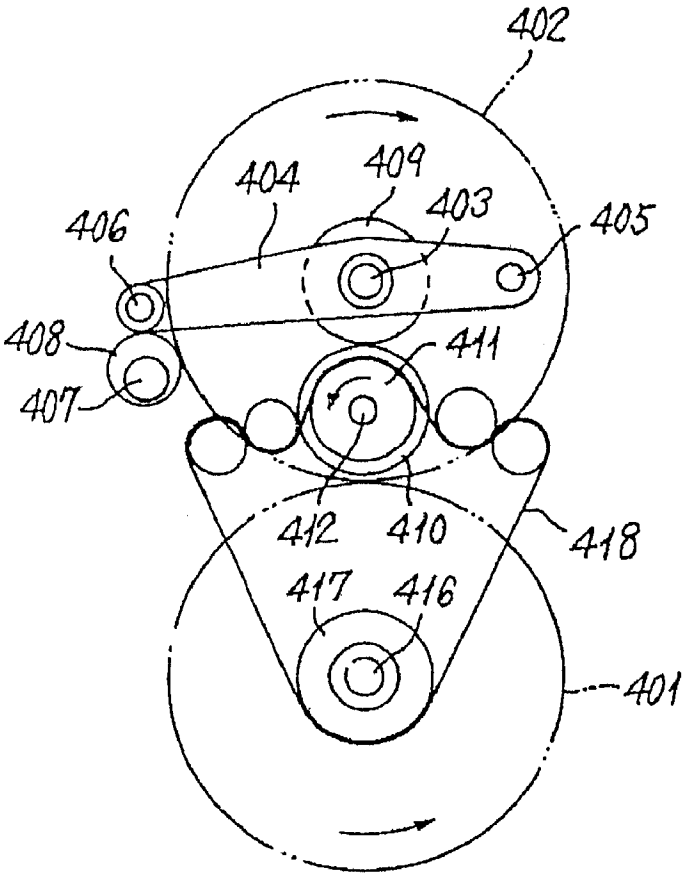
FIG. 17 is a front view showing another alternative embodiment of the present invention.

Referring to FIGS. 17 and 18, the alternative embodiment includes print drums 401 and 402 that are a drive member and a driven member, respectively. The print drum 402 faces the print drum 401 and is movable into and out of contact with the print drum 401, so that a duplex print carrying images on both sides thereof is available. The drums 401 and 402 are identical with the drums 308 and 310 of the previous embodiments as to configuration and ink feed system and will not be described specifically in order to avoid redundancy.

The print drum 402 is mounted on a shaft 403 that serves as an ink feed pipe at the same time. A support arm 404 is rotatably mounted on one end of the shaft 403 at its intermediate portion. One end of the support arm 404 is rotatably supported by a shaft 405 such that the arm 404 is movable up and down about the shaft 405. A cam roller or cam follower 406 is rotatably supported by the other end of the support arm 404. Biasing means, not shown, constantly presses the cam roller 406 against a cam 408 mounted on a shaft 407. The cam 408 causes the print drum 402 to move into and out of contact with the print drum 401 via the cam roller 406 and support arm 404.

A drum gear 409 is mounted on the shaft 403 that supports the print drum 402. A drive gear 410 and a toothed drive pulley 411 are mounted on a drive shaft 412. The drive gear 410 is held in mesh with the drum gear 409. The drive gear 410 and drive pulley 411 are rotatable in synchronism with the print drums 401 and 402 in a direction indicated by an arrow in FIG. 17.

As shown in FIG. 18, a support arm 413 is rotatably mounted on the drive shaft 412. Two pairs of idle pulleys 414 and 415 are mounted on the support arm 413 at opposite sides of the drive pulley 411.

A toothed driven pulley 417 is mounted on one end of the shaft 416, which supports the print drum 401, and rotatable in synchronism with the print drum 401. A timing belt 418 whose one surface is toothed is passed over the drive pulley 411, outer idle pulleys 414, and driven pulley 417. The inner idle pulleys or rotary members 415 are rotatable in contact with the rear surface of the timing belt 418.

A motor 419 has an output shaft formed with a male screw 420. A female screw, not shown, is formed in one end of the support arm 413 and held in mesh with the male screw 420. The motor 419 is rotatable to adjust the position of the print drum 401 in the to-and-bottom direction. For example, assume that the motor 419 is rotated in such a manner as to angularly move the support arm 413 clockwise, as viewed in FIG. 18. Then, the left idle pulleys 414 and 415 pull the timing belt 418 while the right idle pulleys 414 and 415 feed the belt 418, causing the driven pulley 416 to rotate clockwise. Consequently, the deviation of the relative phase between the print drums 401 and 402 is corrected.

In the illustrative embodiment, too, the eccentricity component of the timing belt 418 ascribable to irregular thickness appears via the idle pulleys 415, which contact the rear surface of the belt 418, and causes the relative phase between the print drums 401 and 402 to vary between consecutive printing. This deviation, however, can be reduced if the rear surface of the timing belt 418 is ground as in the previous embodiments. The grinding system and the method of producing the timing belt described in relation to the previous embodiments are applicable to this embodiment also. The illustrative embodiment, like the previous embodiments, is applicable to the configuration shown in FIGS. 5 and 6 of the previously mentioned Laid-Open Publication No. 8-216381 and the configuration taught in Laid-Open Publication No. 9-66657.

In summary, it will be seen that the present invention provides a printer having various unprecedented advantages, as enumerated below.

(1) A timing belt has its rear surface ground in order to have uniform thickness. This successfully reduces the deviation of a relative phase between rotary members ascribable to the varying thickness of the entire timing belt, thereby making the most of the low-cost configuration of timing belt connection.

(2) In a single-pass type of color printer, the uniform thickness of the timing belt reduces an offset ghost ascribable to the varying thickness of the entire timing belt. This also makes the most of the low-cost configuration of timing belt connection.

(3) The timing belt is a single molding produced by winding a core wire around a mold. The resulting accurate position of the core wire reduces the deviation of a relative phase between rotary members or an offset ghost at the same time as grinding reduces it. Consequently, the above deviation or the offset ghost ascribable to the eccentricity component of the timing belt is highly accurately reduced.

(4) Polyurethane resin insures high dimensional accuracy and reduces the deviation of the relative phase or the offset ghost more accurately.

(5) The rear surface of the timing belt is ground by either one of a tooth-crest reference scheme and a bottom-land reference scheme. Grinding can therefore be effected with accuracy high enough to further promote the accurate reduction of the phase deviation or the offset ghost.

Various modifications will become possible for those skilled in the art after receiving the teachings of the present disclosure without departing from the scope thereof.

What is claimed is:

1. A printer comprising:

a plurality of print drums located at a preselected interval in a sheet feed direction in which a sheet is conveyed;

a drive pulley configured to rotate one of said plurality of print drums positioned at an upstream side in the sheet feed direction;

a driven pulley configured to rotate another print drum positioned at a downstream side in the sheet feed direction;

a timing belt passed over said drive pulley and said driven pulley to cause said print drum at the upstream side and said print drum at the downstream side to rotate in synchronism with each other;

an adjustment pulley pair held in mesh with said timing belt; and steer pulley pairs respectively positioned between said drive pulley and said adjustment pulley pair and between said driven pulley and said adjustment pulley pair and held in contact with a rear surface of said timing belt for steering said timing belt, wherein said timing belt is ground such that a distance between tips of teeth of said timing belt and said rear surface is maintained constant with a variation of less than 0.1 mm over an entire length of said timing belt, and said adjustment pulley pair is movable to vary synchronism between said print drum at the upstream side and said print drum at the downstream side, wherein a turning period of said timing belt is an integral multiple of both of a rotation period of said drive pulley and a rotation period of said driven pulley.

2. A phase control device comprising:

a drive pulley mounted on a drive member;

a driven pulley mounted on a driven member;

a timing belt passed over said drive pulley and said driven pulley to cause said drive member and said driven member to rotate in synchronism with each other;

an adjustment pulley pair held in mesh with said timing belt; and steer pulley pairs respectively positioned between said drive pulley and said adjustment pulley pair and between said driven pulley and said adjustment pulley pair and held in contact with a rear surface of said timing belt for steering said timing belt, wherein said timing belt is ground such that a distance between tips of teeth of said timing belt and said rear surface is maintained constant with a variation of less than 0.1 mm over an entire length of said timing belt, and said adjustment pulley pair is movable to vary synchronism between said drive member and said driven member, wherein a turning period of said timing belt is an integral multiple of both of a rotation period of said drive pulley and a rotation period of said driven pulley.

3. A printing method comprising the steps of:

(a) providing a plurality of print drums located at a preselected interval in a sheet feed direction in which a sheet is conveyed, a drive pulley configured to rotate one of said plurality of print drums positioned at an upstream side in the sheet feed direction, a driven pulley configured to rotate another print drum positioned at a downstream side in said sheet feed direction, a timing belt passed over said drive pulley and said driven pulley to cause said print drum at said upstream side and said print drum at said downstream side to rotate in synchronism with each other, an adjustment pulley pair held in mesh with said timing belt, and steer pulley pairs respectively positioned between said drive pulley and said adjustment pulley pair and between said driven pulley and said adjustment pulley pair and held in contact with a rear surface of said timing belt for steering said timing belt;

(b) grinding said timing belt to such a degree that a distance between a core wire and the rear surface thereof becomes smaller than a distance before grinding;

(c) maintaining a distance between tips of teeth of said timing belt before grinding and said rear surface constant with a variation of less than 0.1 mm over an entire length of said timing belt; and (d) causing said adjustment pulley pair to move to vary synchronism between said print drum at the upstream side and said print drum at the downstream side, wherein a turning period of said timing belt is an integral multiple of both of a rotation period of said drive pulley and a rotation period of said driven pulley.

4. A phase control method comprising the steps of:

(a) preparing a drive pulley mounted on a drive member, a driven pulley mounted on a driven member, a timing belt passed over said drive pulley and said driven pulley to cause said drive member and said driven member to rotate in synchronism with each other, an adjustment pulley pair held in mesh with said timing belt, and steer pulley pairs respectively positioned between said drive pulley and said adjustment pulley pair and between said driven pulley and said adjustment pulley pair and held in contact with a rear surface of said timing belt for steering said timing belt;

(b) grinding said timing belt to such a degree that a distance between a core wire and the rear surface thereof becomes smaller than a distance before grinding;

(c) maintaining a distance between tips of teeth of said timing belt before grinding and said rear surface constant with a variation of less than 0.1 mm over an entire length of said timing belt; and (d) causing said adjustment pulley pair to move to vary synchronism between said drive member and said driven member, wherein a turning period of said timing belt is an integral multiple of both of a rotation period of said drive pulley and a rotation period of said driven pulley.

* * * * *